US009630405B2

(12) United States Patent
Nagatsuka et al.

(10) Patent No.: US 9,630,405 B2
(45) Date of Patent: Apr. 25, 2017

(54) PRINTING ELEMENT SUBSTRATE, LIQUID EJECTION HEAD, AND LIQUID EJECTION APPARATUS

(71) Applicant: CANON KABUSHIKI KAISHA, Tokyo (JP)

(72) Inventors: Toshikazu Nagatsuka, Tokyo (JP); Masaki Oikawa, Inagi (JP); Atsushi Omura, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 124 days.

(21) Appl. No.: 14/792,025

(22) Filed: Jul. 6, 2015

(65) Prior Publication Data

US 2016/0009078 A1 Jan. 14, 2016

(30) Foreign Application Priority Data

Jul. 10, 2014 (JP) ..... 2014-142444

(51) Int. Cl.

| | |
|---|---|
| ***B41J 29/38*** | (2006.01) |
| ***B41J 2/14*** | (2006.01) |
| ***B41J 2/045*** | (2006.01) |

(52) U.S. Cl.
CPC ..... *B41J 2/14153* (2013.01); *B41J 2/0454* (2013.01); *B41J 2/14072* (2013.01)

(58) Field of Classification Search
CPC ... B41J 2/0454; B41J 2/04553; B41J 2/04563
See application file for complete search history.

(56) References Cited

U.S. PATENT DOCUMENTS 6,068,363 A * 5/2000 Saito ..... B41J 2/04541 347/17

FOREIGN PATENT DOCUMENTS

| | | |
|---|---|---|
| JP | 2009-262510 A | 11/2009 |
| JP | 2010-120301 A | 6/2010 |

* cited by examiner

*Primary Examiner* — Juanita D Jackson
(74) *Attorney, Agent, or Firm* — Fitzpatrick, Cella, Harper & Scinto

(57) ABSTRACT

A printing element substrate is provided that can provide an accurate temperature detection of a printing element substrate and that can suppress the printing element substrate from having a larger size. In order to realize this, sensors are arranged along the heating resistor elements arranged in the printing element substrate so that more diode sensors are arranged at a higher density in a part having a higher temperature change of the printing element substrate during the liquid ejection operation from the ejection openings.

14 Claims, 11 Drawing Sheets

PRINTING ELEMENT SUBSTRATE, LIQUID EJECTION HEAD, AND LIQUID EJECTION APPARATUS

BACKGROUND OF THE INVENTION

Field of the Invention

The present invention relates to a liquid ejection apparatus for ejecting liquid through an ejection opening to perform printing and a liquid ejection head and a printing element substrate used for the liquid ejection apparatus.

Description of the Related Art

Liquid ejection apparatuses include, for example, a liquid ejection apparatus in which a liquid ejection head can be used to use thermal energy from a heating resistor element to eject liquid through ejection openings provided in a printing element substrate. In order to allow this type of liquid ejection apparatus to obtain a favorable image, for the purpose of minimizing a density variation or an uneven density of a printed image for example, various controls have been performed to stabilize the ejection amount ejected through liquid ejection heads.

A higher liquid temperature causes a lower liquid viscosity and thus liquid can be ejected more easily, thereby providing a higher ejection amount. Thus, a liquid ejection apparatus controls a liquid viscosity having an influence on the ejection amount for example by adjusting the liquid temperature (hereinafter also may be referred to as "temperature adjustment"). In the case of such a liquid ejection head, the temperature of the printing element substrate highly has an influence on the liquid temperature. In the case of a liquid ejection head in which a printing element substrate including a plurality of heating resistor elements is provided in a support body having a high thermal conductivity, the heat from the printing element substrate is diffused to the support body.

Thus, the temperature of the entire printing element substrate can be predicted by providing temperature sensors at an end and the center of the printing element substrate. Japanese Patent Laid-Open No. 2009-262510 discloses a method of providing, in order to accurately measure a rapid temperature change of a flow path connected to an ejection opening in particular in the vicinity of a liquid ejection head, temperature sensors are provided at an end and a plurality of positions of the center of the flow path connected to the ejection opening.

However, in the case of the method disclosed in Japanese Patent Laid-Open No. 2009-262510, although a temperature change of the printing element can be known, the temperature change cannot be reflected on the control of the respective ejection openings. Therefore, not only the temperature detection at an end and the center but also a more detailed temperature detection are required. Thus, a temperature sensor can be provided in the vicinity of the ejection opening to thereby provide a more detailed temperature detection and a heater can be driven-controlled in accordance with the temperature in the vicinity of an ejection opening to thereby provide a higher printing quality. Japanese Patent Laid-Open No. 2010-120301 discloses a method of detecting an ejection failure by an independent temperature detection unit to individually detect the temperatures of the respective ejection openings.

However, temperature sensors are provided in the vicinity of if all ejection openings, such wirings are required that are used to cause constant current corresponding to the number of the sensors to flow and a voltage is outputted, thus undesirably resulting in a printing element substrate having a larger size. Furthermore, in order to provide a feedback to a control for an individual detection and a printing control based on an individually-detected temperature, a higher data amount is required, thus causing a slower printing speed.

SUMMARY OF THE INVENTION

In view of the above, it is an objective of the present invention to solve the above disadvantage. Specifically, a printing element substrate, a liquid ejection head and a liquid ejection apparatus are provided that can provide an accurate temperature detection of a printing element substrate and that can suppress the printing element substrate from having a larger size.

Therefore, a printing element substrate of the present invention is printing element substrate comprising a plurality of ejection openings for ejecting liquid and a plurality of temperature detection elements provided along the ejection openings. The temperature detection elements are arranged at a higher density during an operation for ejecting ink through the ejection openings in a part having a higher temperature change of the printing element substrate.

According to the present invention, the printing element substrate can provide an accurate temperature detection of the printing element substrate and can suppress the printing element substrate from having a larger size.

Further features of the present invention will become apparent from the following description of exemplary embodiments (with reference to the attached drawings).

DESCRIPTION OF THE EMBODIMENTS (First Embodiment)

The following section will describe the first embodiment of the present invention with reference to the drawings.

Figure 1:
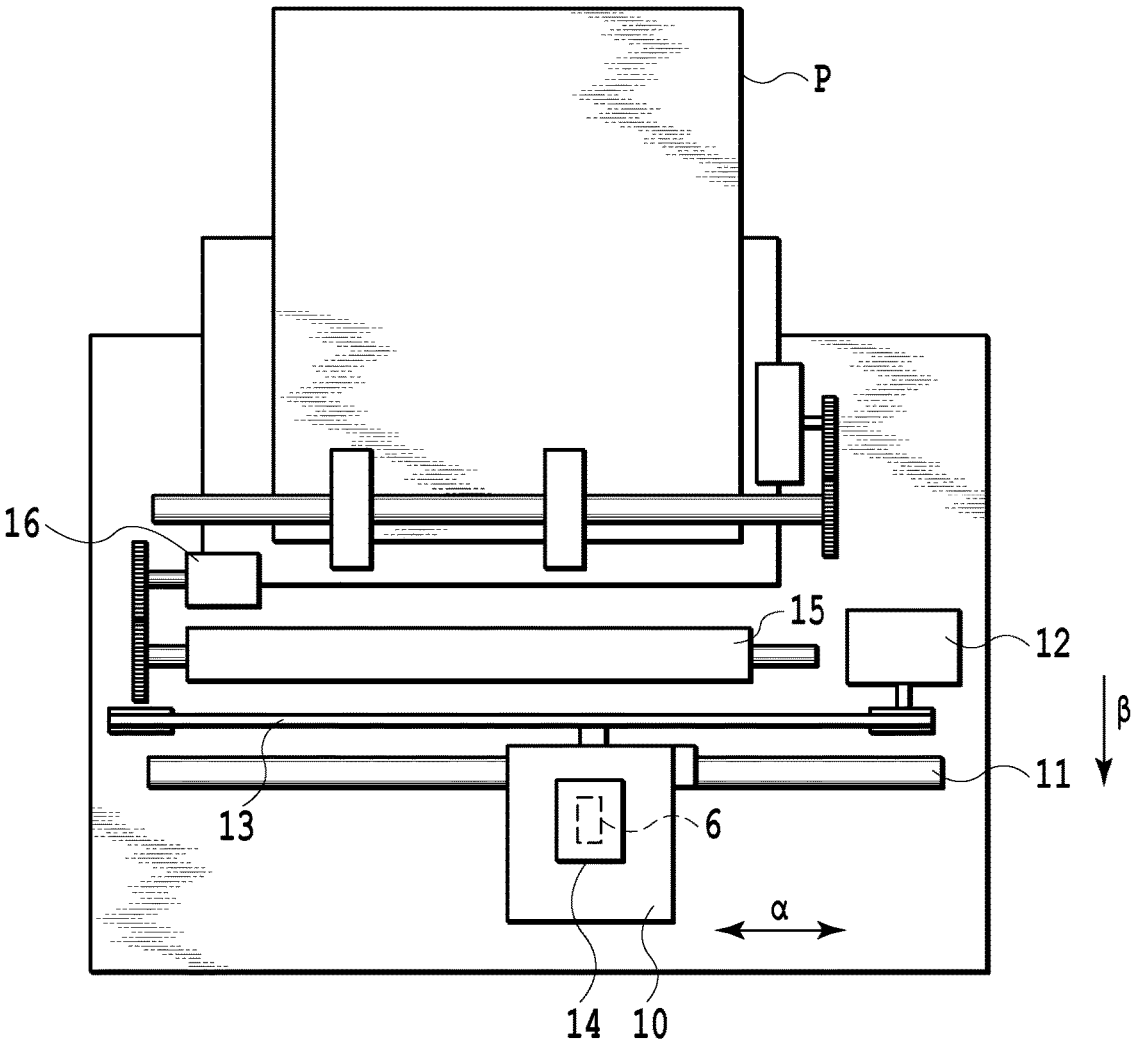
FIG. 1 is a schematic view illustrating a liquid ejection apparatus.

FIG. 1 is a schematic view illustrating a liquid ejection apparatus to which this embodiment can be applied. A carriage 10 is supported by a guide shaft 11 so that the carriage 10 can reciprocate in a main scanning direction (a direction shown by arrow $\alpha$). This carriage 10 reciprocates along the guide shaft 11 by driving a carriage motor 12 to move a driving belt 13. The carriage 10 can include a liquid ejection head 14. The liquid ejection head 14 includes a printing element substrate 6. The printing element substrate 6 includes ejection openings for ejecting liquid (hereinafter also maybe referred to as ink) that are arranged in a plurality of columns.

At a position opposed to an ejection opening of the liquid ejection head 14, a heating resistor element for generating thermal energy for ejecting ink (hereinafter also may be referred to heater) is provided. This serial-type liquid ejection apparatus includes a conveying mechanism to convey a printing medium P (e.g., a plain paper, a high quality exclusive paper, an OHP sheet, a glossy paper, a glossy film, a postcard). This conveying mechanism has conveying roller 15 and a conveying motor 16 for driving the conveying roller 15. The printing medium P is intermittently conveyed in a sub-scanning direction (a direction shown by an arrow β) in accordance with the driving of conveying motor 16. An image is formed over the entire printing medium P by repeating an operation to move the printing head 14 and the printing medium P relative to each other.

Figure 2:
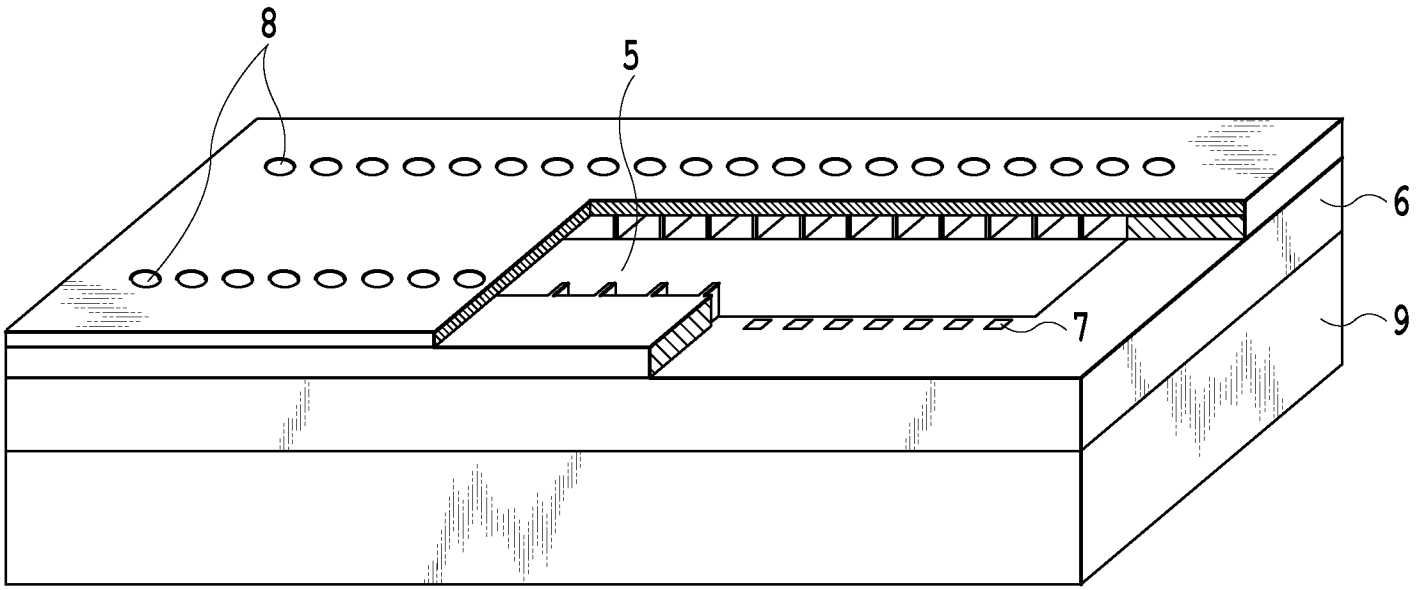
FIG. 2 is a perspective view illustrating a printing element substrate and a support body for supporting the substrate.

The following section will describe a printing element substrate 6 provided in the liquid ejection head 14. FIG. 2 is a perspective view illustrating the printing element substrate 6 and a support body 9 for supporting the printing element substrate 6. The shown printing element substrate 6 has a circuit formed on a silicon semiconductor substrate for example using a semiconductor device manufacture technique. This printing element substrate 6 has a substantially rectangular shape in which the center has an ink supply opening (liquid supply opening) 5 functioning as a substantially-rectangular penetration hole extending in the longitudinal direction.

Along both edges of the ink supply opening 5, heater columns (heating resistor element columns) are provided in which a plurality of heaters 7 are arranged. The heater 7 is formed on one face of the printing element substrate 6 (hereinafter also may be referred to a surface). The heater 7 heats liquid (ink) supplied through the ink supply opening 5 from the other face of the printing element substrate 6 (hereinafter referred to as a back face) to thereby foam the liquid (ink). As a result, ink droplets are ejected through ejection opening 8 provided to be opposed to heater 7. Ejection openings 8 forms a column as shown and are provided from a position in the vicinity of one end of the printing element substrate to a position in the vicinity of the other end. The printing element substrate 6 is provided on the support body 9 including an ink flow path section. The printing element substrate 6 and the support body 9 are fixed by adhesive agent having a superior ink resistance for example. The support body 9 is made of resin material having a thermal conductivity of 0.5 W/make such as plastic in order provide a low-cost support.

Figure 3:
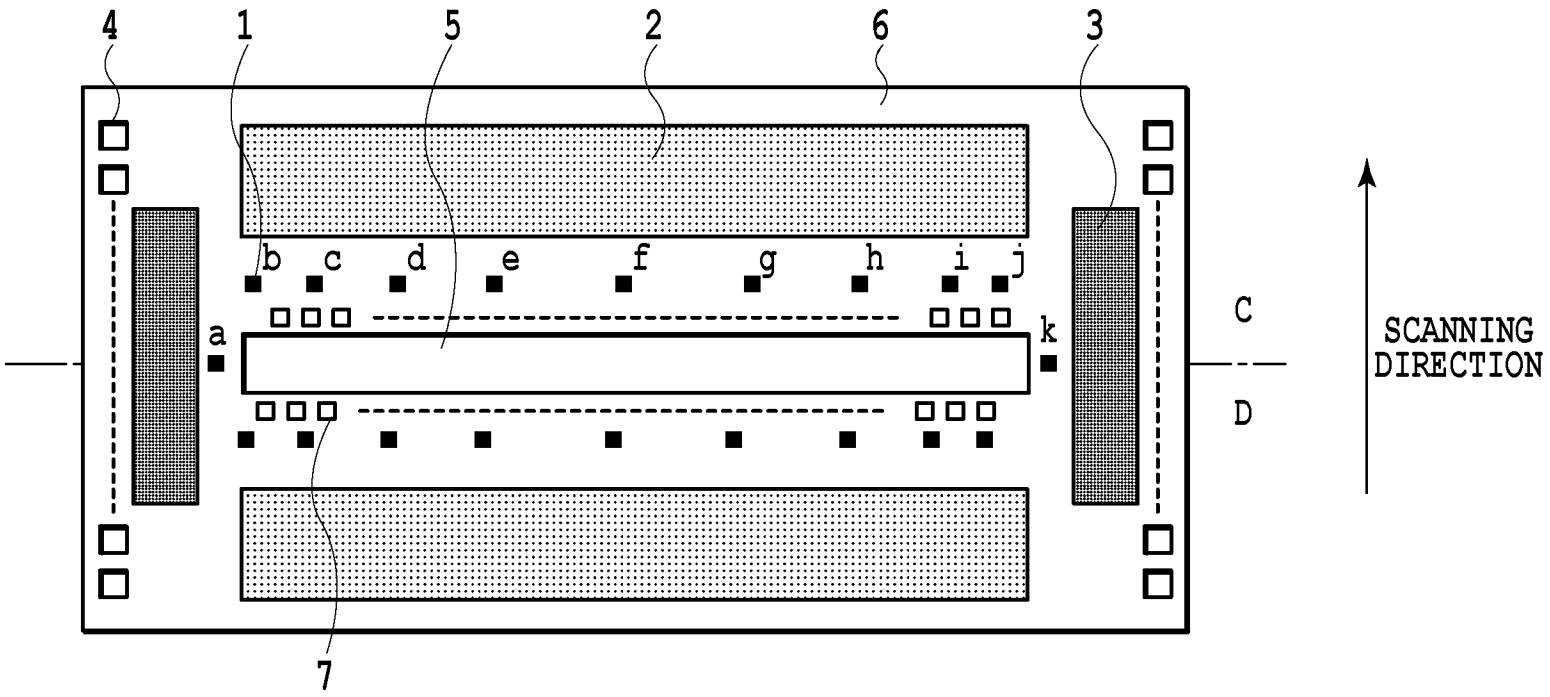
FIG. 3 is a plan view of the printing element substrate.

FIG. 3 is a plan view illustrating the printing element substrate 6. The supply opening 5 is sandwiched between the heater 7 and the driver section 2 provided at an opposite side of the ink supply opening 5. The driver section (driver circuit) 2 includes drivers for driving the respective heaters 7. The driver is typically provided for each heater 7 and is composed of a transistor for a switch for example. The printing element substrate 6 further includes a logic circuit section 3 and a pad section 4 for supplying a power source and a signal from the apparatus body side to this printing element substrate 6. The logic circuit section 3 and the pad section 4 is provided at an end of the printing element substrate 6 in the longitudinal direction.

The pad section 4 includes a plurality of pads and uses an electric connection unit (e.g., wire bonding) to electrically connect the circuit on the printing element substrate 6 to the body of the liquid ejection apparatus. The logic circuit section 3 includes a logic circuit to control, when a signal is given from the apparatus body side via the pad of the pad section 4, ON/OFF of the respective transistors in the driver section 2 based on the signal.

The printing element substrate 6 is configured so that the periphery of the ink supply opening 5 has a diode sensor 1 functioning as a temperature detection element provided between the driver section 2 and the heater 7 and between the logic circuit section 3 and the ink supply opening 5. A plurality of diode sensors 1 are arranged along the column of the heaters 7 to form a column (a temperature detection element column) . The diode sensors 1 are also provided on an extension line at one end side of the ink supply opening 5 and an extension line at the other end side. The diode sensor 1, which is provided between the logic circuit section 3 and the ink supply opening 5 is provided on the center line of the ink supply opening 5. The diode sensor 1, which is provided between the driver section 2 and the heater 7, is provided on a line intersecting with the center line of ink supply opening 5.

The diode sensor 1 has a characteristic according to which the output voltage declines in accordance with a temperature increase during the application of constant current. This characteristic can be used to monitor the substrate temperature during ink ejection from the apparatus body side. Although the diode sensor 1 is provided in this example, an aluminum wiring also may be provided in a meandering manner to have an increased resistance value. In this case, a characteristic is provided according to which the output voltage increases in accordance with a temperature increase during the application of a constant current, which can be used for a substrate temperature measurement.

Sensor material is not limited to aluminum and includes resistance material that can use any of copper, silver, gold, tantalum, titanium, nickel, polysilicon as wiring material, or diffusion resistance material prepared by doping for example. Specifically, sensor material maybe any material so long as the material has a characteristic according to which the output voltage increases in accordance with a temperature increase during the application of a constant current.

Figure 4:
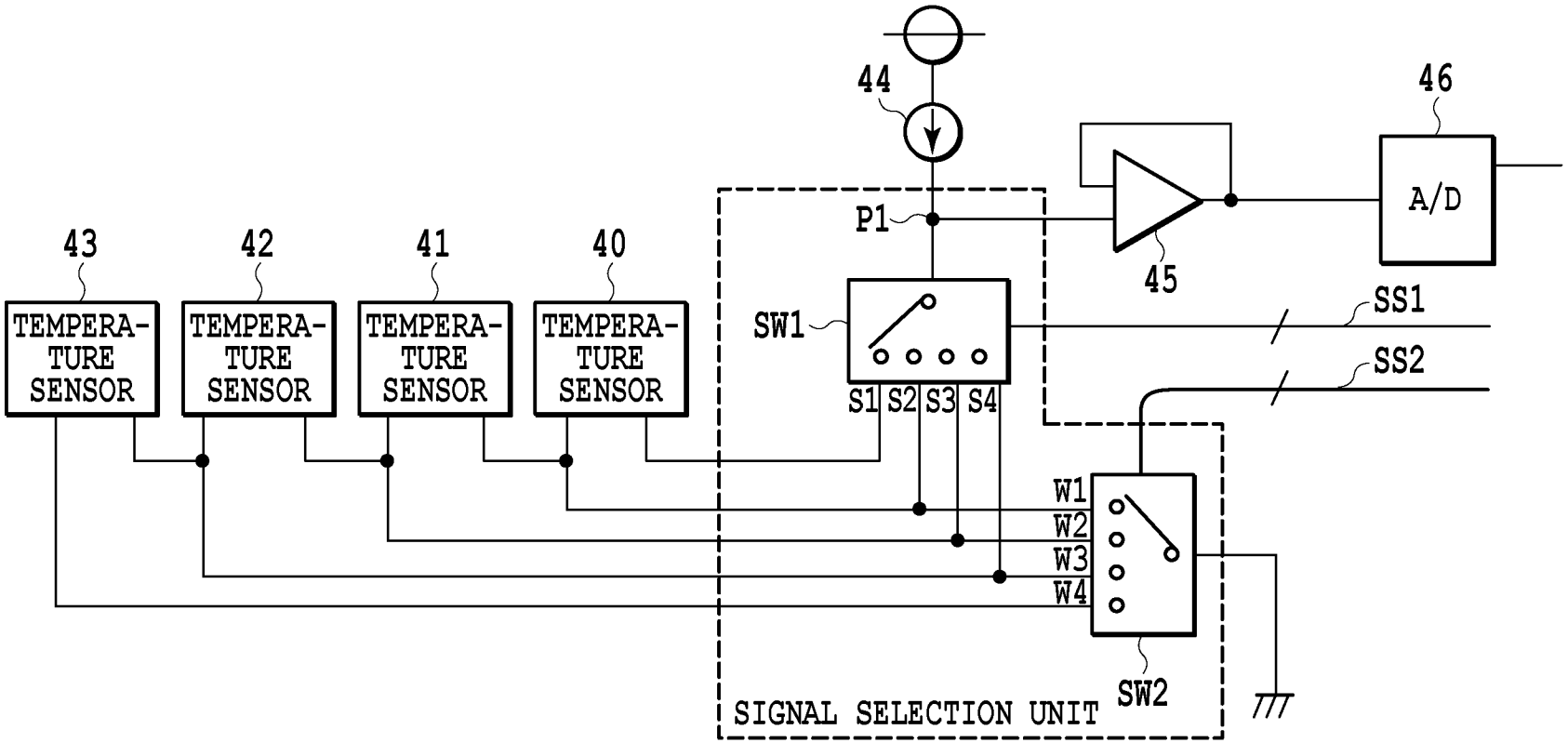
FIG. 4 illustrates an external output circuit of a temperature sensor signal and a signal selection unit of a printing element substrate including four diode sensors.

Next, a unit will be described that senses a temperature from a plurality of temperature diode sensors 1. FIG. 4 illustrates an external output circuit of a temperature sensor signal and a signal selection unit of the printing element substrate 6 including four diode sensors 1. The signal selection unit is composed of an analog switch SW1 and an analog switch SW2. Temperature sensors 40 to 43 are a temperature detection element composed of resistance material. A method will be described to individually measure temperature sensor values.

When a temperature is measured by any one of the temperature sensors 40 to 43, a 2 bit selection signal SS1 and a 2 bit selection signal SS2 are inputted to the respective analog switches SW1 and SW2 so that the current from a constant current source 44 flows into any of the temperature sensors. When a temperature is measured by the temperature sensor 40, the circuit S1 of the analog switch SW1 and the circuit W1 of the analog switch SW2 are selected to thereby supply constant current to the temperature sensor 40. Specifically, the first selection signal SS1 selects the circuit S1 of the analog switch SW1 and the second selection signal SS2 selects the circuit W1 of the analog switch SW2 to thereby allow the constant current to flow in the temperature sensor 40.

Voltages at both ends of the temperature sensor 40 have a voltage value proportional to a temperature change. Thus, voltages at both ends of this temperature sensor 40 are subjected to an amplification processing by an operational amplifier 45 and are converted by an A/D converter 46 to digital data and the data is inputted to a control circuit (not shown) and is processed as temperature data. Similarly, when a temperature is measured by the temperature sensor 41, the first selection signal SS1 selects the circuit S2 of the analog switch SW1 and the third selection signal SS2 selects the circuit W2 of the analog switch SW2 to thereby allow the constant current to flow in the temperature sensor 41.

When a temperature is measured by the temperature sensor 42, the first selection signal SS1 selects the circuit S3 of the analog switch SW1 and the second selection signal SS2 selects the circuit W3 of the analog switch SW2 to thereby allow the constant current to flow in the temperature sensor 42. When a temperature is measured by the temperature sensor 43, the first selection signal SS1 selects the circuit S4 of the analog switch SW1 and the second selection signal SS2 selects the circuit W4 of the analog switch SW2 to thereby allow the constant current to flow in the temperature sensor 43.

Figure 5:
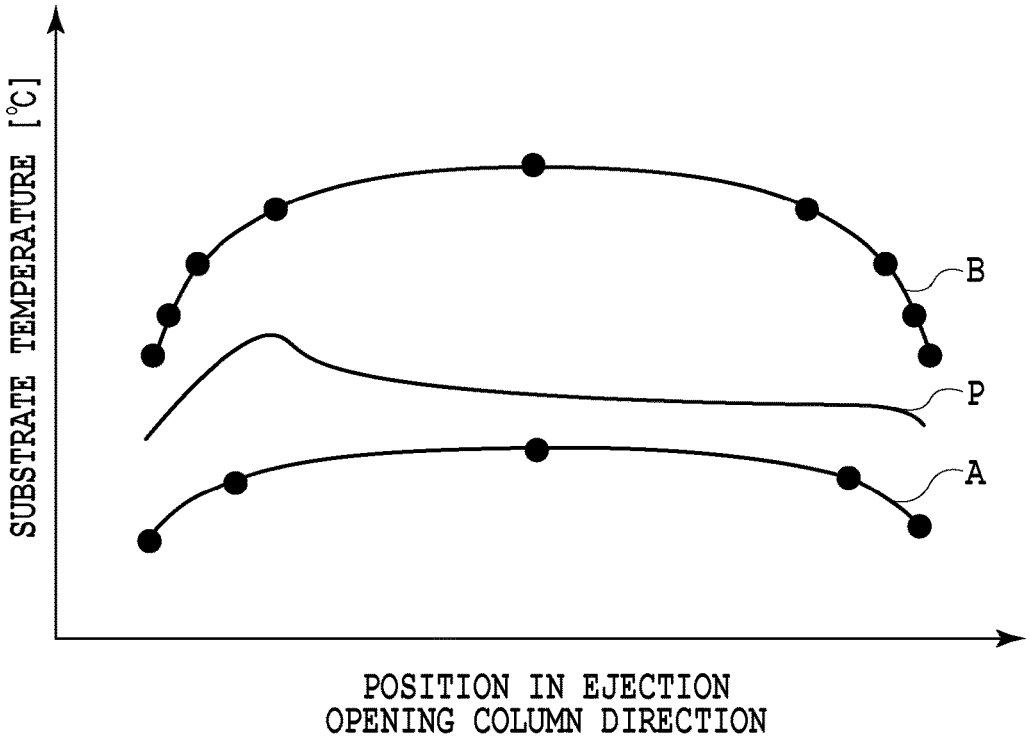
FIG. 5 is a graph illustrating the temperature of the printing element substrate.

FIG. 5 is a graph illustrating the temperature of the printing element substrate. The following section will describe the temperature distribution in the printing element substrate 6 during printing. An example is shown in which such a pattern is printed that uniformly uses the entire ejection opening driven at a high ejection frequency. During printing, heat generated at the center of the printing element substrate 6 is diffused to both ends while heat generated at an end is diffused only at the center of the substrate.

When the support body 9 has a high thermal conductivity such as in the case of alumina ceramic, thermal diffusion toward the support body 9 also occurs. However, in this embodiment, a case is considered in which the support body 9 has a low thermal conductivity and thus the heat generated within the printing element substrate is not substantially diffused.

When the support body 9 uses a member having a low thermal conductivity, it can be seen that the substrate has a temperature distribution as shown by the curve B in which the temperature at the center is higher than that at an end and the end has a higher temperature change. When plotting based on a certain fixed temperature change amount is performed, the plot shown on the curve B is obtained. A plotting interval in the ejection opening column direction is narrower toward the end from the center. As described above, when an individual driving control for each ink temperature is performed for the purpose of improving a printed image quality, the driving control is desirably performed for a fixed temperature region. In the case of the temperature distribution as shown by the curve B, a plot position is assumed as a boundary and different heating resistor elements for the respective ejection openings are driven-controlled.

As can be seen from the above, the diode sensor 1 used for temperature detection is desirably provided at a plot position of the curve B. If the diode sensor 1 is provided in consideration of the temperature distribution when the highest ejection frequency and all ejection openings are used in the liquid ejection apparatus, anymore temperature change does not occur, thus providing sufficient temperature detection.

On the other hand, an increased number of the diode sensors 1 provides a more detailed temperature detection. However, as shown in FIG. 4, an increased number of wirings from the diode sensor 1 is caused. This causes the printing element substrate 6 to have a larger size, which is not preferable. An increased number of the diode sensors 1 causes a proportional increase in time required for detection, which makes it difficult to perform a high-speed printing control while maintaining a high image quality. Therefore, the number of the diode sensors 1 is desirably minimized.

As described above, the printing element substrate is configured so that a part having a high temperature change during printing includes the diode sensors 1 arranged at a high density. In this embodiment, during printing, a temperature change is more remarkable at an end of the printing element substrate than at the center and more diode sensors 1 are provided in a higher density in a direction from the center to the end of the printing element substrate. However, the invention is not limited to this. Specifically, a part having a high temperature change during printing may change depending on the configuration of the apparatus for example. Thus, depending on each configuration, the diode sensors may be provided at a high density in a part having a high temperature change during printing.

The following section will describe a specific embodiment in the present invention. A size or a value in the following respective embodiments is an example and the invention is not limited to this. In this embodiment, an example of a printing driving control method will be described in the printing element substrate 6 including one ink supply opening 5 to use the temperature detection using 20 diode sensors 1 and the detected temperature.

The printing element substrate 6 of FIG. 3 (hereinafter also may be referred to as substrate) will be described in detail. The substrate 6 has a long side size of 1.07 inches. Ejection openings for ejecting ink are arranged so that 640 ejection openings are arranged at the C side and the D side at both sides of the ink supply opening 5 to thereby form the total of 1280 ejection openings. The ejection openings are arranged at the C side and the D side in the vertical direction to the scanning direction of the ink jet printing head during printing at a pitch of 600 dpi, respectively. The ejection openings are arranged in a manner dislocated by a ½ pitch at the C side and the D side to thereby constitute the entirety having an ejection opening resolution of 1200 dpi. Ink viscosity is 3.0 mPa·s and the surface tension is 37.0 mN/m. The support body 9 of the printing element substrate 6 has a thermal conductivity of 0.29 W/make having a relatively low conductivity.

The diode sensors 1 for temperature detection are arranged as shown in FIG. 3 and the total of 20 diode sensors 1 are provided on the substrate. The diode sensor 1 at the farthest end is provided so that the diode sensor is provided on the boundary line between C and D passing through the center of the ink supply opening 5 and is in the vicinity of ejection openings. The diode sensors 1 at the C side and the D side are arranged to be dislocated by a ½ pitch as in the ejection openings arranged to be dislocated by a ½ pitch.

The diode sensors 1 are arranged with a narrower interval from the center to the end (or with a higher density) and 9 diode sensors 1 are provided at the C side and the D side, respectively. Thus, 11 C-side ejection openings can be used to predict the temperature distribution within the substrate. The same applies to the D-side ejection openings. Specifically, with regard to a direction along which a plurality of ejection openings 8 are arranged, the heating resistor elements 7 provided at an end of the printing element substrate 6 are arranged with a higher density than that at which the heating resistor elements 7 provided at the center side of the printing element substrate 6 are arranged.

When the respective ejection openings are driven for printing at an ejection frequency of 24 kHz, then the 11 C-side diode sensors 1 shows, immediately after driving, a detected temperature as shown by the curve B of FIG. 5. The ejection openings are provided at an equal interval and an equal amount of heat is generated from each ejection opening. In the case of the printing element substrate having a shape as shown in FIG. 3, the temperature distribution among the diode sensors 1 can be predicted to be continuous as shown by the curve B. Even when not all but a part of the ejection openings is used for ink ejection, a continuous temperature distribution as shown by the curve P can be predicted. This is presumably due to that the thermal conductivity within the printing element substrate is uniform, thus providing a continuous temperature distribution.

The following section will describe the printing control of the next scanning when the temperature distribution as shown by the curve B is detected immediately after the scanning. The following section will describe the C-side diode sensor 1 and the ejection opening. It is assumed that a similar control may be applied to the D-side diode sensors 1 if the D-side diode sensors 1 have a similar temperature distribution.

Figure 6:
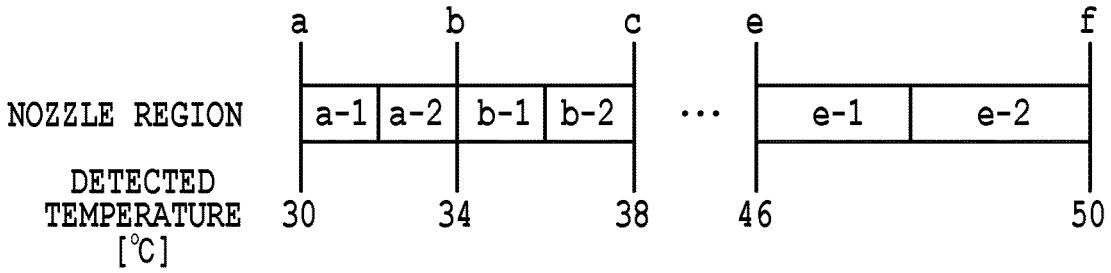
FIG. 6 illustrates how neighboring diode sensors are divided to regions.

FIG. 6 illustrates how neighboring diode sensors 1 (or temperature detection elements) are divided to regions. As shown in FIG. 3, the diode sensors 1 are arranged from an end in an order of a, b, c, d, e, f, g, h, i, j, and k and the detected temperature after one scanning is as shown in FIG. 6 (in which "a" at an end of the substrate to "f" at the center are shown) . Since the detected temperature decreases toward the end, it is predicted that ink at the end side has a high viscosity. Specifically, ink at the end side is suppressed from being ejected during the next scanning than ink at the center side and has a relatively-reduced ejection amount. This causes uneven printing in the ejection opening column direction, thus resulting in a print having a more-lightly-printed end.

Thus, when the printing control (driving control) is changed based on the ink temperature difference ΔT of 2 degrees C., the respective diode sensors 1 are controlled so that the neighboring diode sensors 1 such as a-1, a-2, b-1, b-2, . . . , e-1, and e-2 are controlled based on a detected temperature difference of 4 degrees C. to thereby control the heaters based on 4 degrees C./2 degrees C.=the respective 2 regions. In this case, for example, a temperature set in the region a-1 is 30 degrees C., a temperature set in the region a-2 is 32 degrees C., and a temperature set in the region b-1 is 34 degrees C. When it is desired that the ink temperature difference ΔT is changed to 1 degrees C., the heaters may be controlled based on 4 degrees C./1 degrees C.=4 regions. A specific driving control includes a pulse control method according to which the heater 7 corresponding to an ejection opening in a region having a low temperature is given with a higher heat amount.

When the neighboring diode sensors 1 have therebetween no detected temperature after the second scanning, there is no need to divide the neighboring diode sensors 1 to printing driving control regions as described above and the same driving control may be used. As described above, a driving control region may be changed depending on a detected temperature at each scanning and the detected temperature can be used to improve the printing image quality.

If it is predicted that the temperature distribution on the printing element substrate has a continuous curve-like temperature distribution and the symmetry of the temperature distribution is considered, diode sensors 1 provided on the printing element substrate 6 may be at least one diode sensor 1 at k in FIG. 3, at least one diode sensor 1 at I in FIG. 3, and at least one diode sensor 1 at f in FIG. 3. By using these at least three diode sensors 1, the temperature distribution of the printing element substrate 6 can be predicted.

As described above, sensors are arranged along the heating resistor elements arranged in the printing element substrate so that more diode sensors are arranged at a higher density in a part having a higher temperature change of the printing element substrate during the liquid ejection operation from the ejection openings. Neighboring sensors are divided to regions so that the heaters are controlled for the respective regions. This can consequently realize the printing element substrate that can subject the printing element substrate to an accurate temperature detection and that can suppress the printing element substrate from having a larger size.

(Second Embodiment)

The following section will describe the second embodiment of the present invention with reference to the drawings. This embodiment has the same basic configuration as that of the first embodiment and thus only a characteristic configuration will be described.

In this embodiment, an example of the printing driving control method will be described in the printing element substrate 76 including one ink supply opening 5 that uses the temperature detection using 8 diode sensors and the detected temperature.

Figure 7:
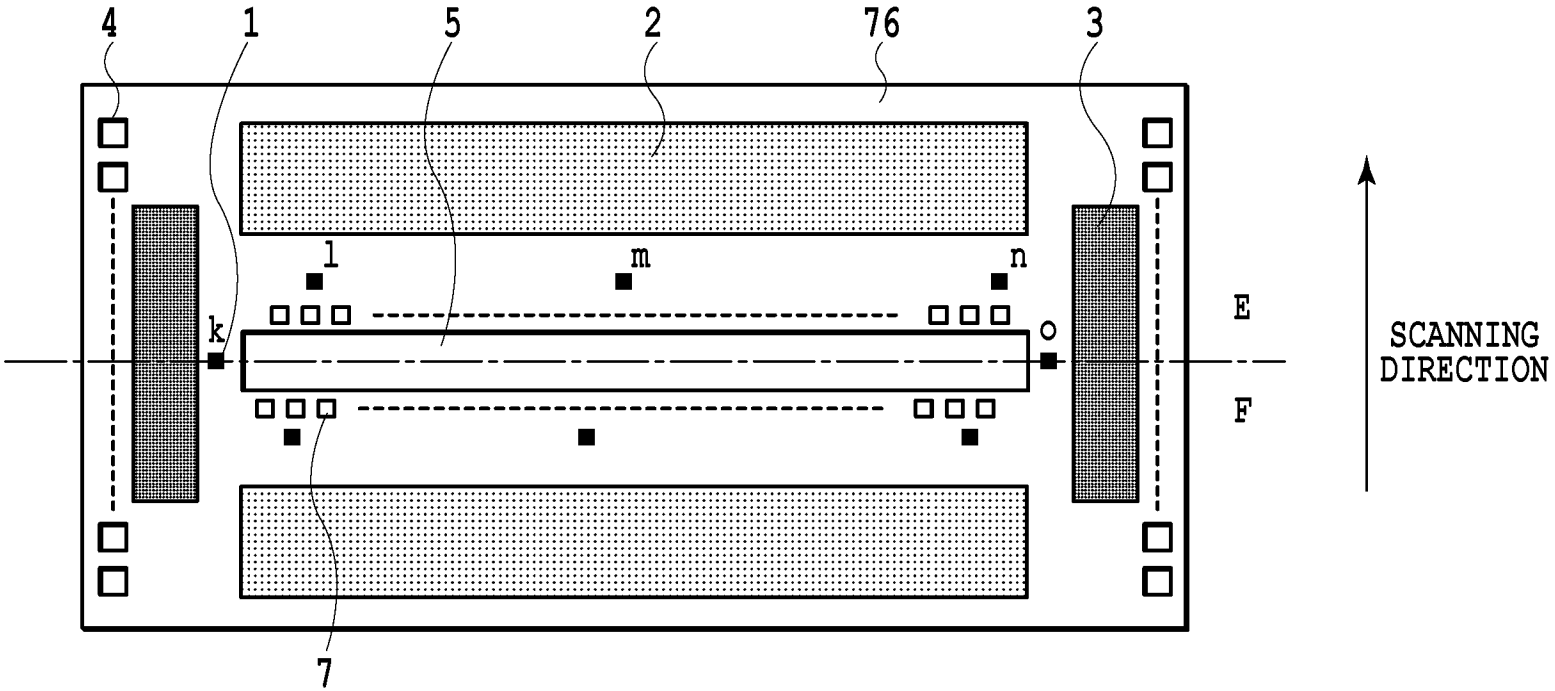
FIG. 7 illustrates a printing element substrate of the second embodiment.
Figure 8:
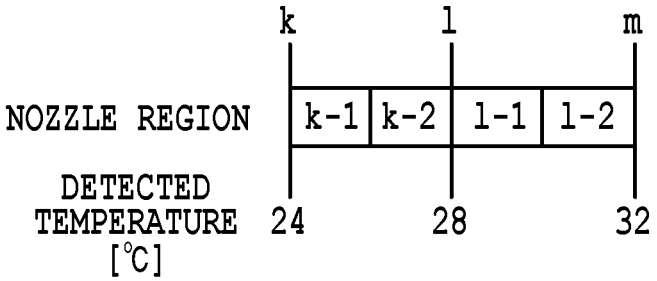
FIG. 8 illustrates how neighboring diode sensors are divided to regions.

FIG. 7 illustrates the printing element substrate of this embodiment. FIG. 8 illustrates how neighboring diode sensors 1 are divided to regions. The printing element substrate 76 has a long side size of 1.07 inches. Ejection openings for ejecting ink are arranged so that 640 ejection openings are arranged at the E side and the F side at both sides of the ink supply opening 5 to thereby form the total of 1280 ejection openings. The ejection openings are arranged at the E side and the F side in the vertical direction vertical to the scanning direction of the ink jet printing head during printing at a pitch of 600 dpi, respectively. The ejection openings are arranged in a manner dislocated by a ½ pitch at the E side and the F side to thereby constitute the entirety having an ejection opening resolution of 1200 dpi. Ink viscosity is 3.0 mPa·s and the surface tension is 37.0 mN/m. The support body 9 of the printing element substrate 6 has a thermal conductivity of 0.5 W/make higher than that used in the first embodiment.

The diode sensors 1 for temperature detection are arranged as shown in FIG. 7 in which the total of 8 diode sensors 1 are arranged on the printing element substrate. The diode sensor 1 at the farthest end is provided so that the diode sensor is provided on the boundary line between E and D passing through the center of the ink supply opening 5 and is in the vicinity of ejection openings. The diode sensors 1 at the E side and the F side are arranged to be dislocated by a ½ pitch as in the ejection openings arranged to be dislocated by a ½ pitch. The diode sensors 1 are arranged with a narrower interval from the center to the end and 3 diode sensors 1 are provided at the E side and the F side, respectively.

By using the 5 diode sensor 1 including the diode sensor 1 at the end, the temperature distribution of the E-side ejection openings within the substrate can be predicted. The same applies to the F-side ejection openings. When the respective ejection openings are continuously driven at an ejection frequency of 24 kHz, the E-side five diode sensors 1 immediately after driving have a detected temperature as shown by the curve A of FIG. 5. The ejection openings are arranged at an equal interval and an equal amount of heat is generated from the respective ejection openings. In the case of the substrate as shown in FIG. 3, the temperature distribution among the diode sensors 1 can be predicted to be continuous as shown by the curve A.

The following section will describe the printing control of the next scanning when the temperature distribution as shown by the curve A is detected immediately after the scanning. The following section will describe the E-side diode sensor 1 and the ejection opening. It is assumed that a similar control may be applied to the F-side diode sensors 1 if the F-side diode sensors 1 have a similar temperature distribution. As shown in FIG. 7, the diode sensors 1 are arranged from an end in an order of k, l, m, n, and o and the temperature after one scanning is assumed as a temperature as shown in FIG. 8 (in which a part to the center is shown). Since the detected temperature decreases toward the end, ink at the end is predicted to have a higher viscosity. Specifically, ink at the end side is suppressed from being ejected during the next scanning than ink at the center side and has a relatively-reduced ejection amount. This causes uneven printing in the ejection opening column direction, thus resulting in a print having a more-lightly-printed end.

Thus, when it is desired that the printing driving control is changed based on the ink temperature difference ΔT of 2 degrees C., the respective diode sensors 1 are controlled so that the neighboring diode sensors 1 such as k-1, k-2, 1-1, and 1-2 of FIG. 8 are controlled based on a detected temperature difference of 4 degrees C. to thereby control the ejection opening based on 4 degrees C/2 degrees C.=2 regions. A specific driving control includes a pulse control method according to which the heater 7 corresponding to an ejection opening in a region having a low temperature is given with a higher heat amount.

When the neighboring diode sensors 1 have therebetween no detected temperature after the second scanning, there is no need to divide the neighboring diode sensors 1 to printing driving control regions as described above and the same driving control may be used. As described above, a driving control region may be changed depending on a detected temperature at each scanning and the detected temperature can be used to improve the printing image quality.

This embodiment is an example in which a fewer diode sensors 1 are used than those of the first embodiment and thus the support body 9 has a higher thermal conductivity than that of the first embodiment. The reason is that, as described above, even when heat is generated from the substrate on the support body 9 having a high thermal conductivity, the heat is diffused to the support body 9 and thus the entire temperature distribution tends to be uniform, thus eliminating the need for a temperature detection at a more-detailed position.

It can be predicted that the temperature distribution on the printing element substrate has a continuous curve-like shape. When considering this, the diode sensors 1 may be provided on the printing element substrate so that at least one diode sensor 1 is provided at o of FIG. 7 (any one on the center line of the ink supply opening 5), at least one diode sensor 1 is provided at n, and at least one diode sensors 1 are provided at m (that are respectively provided on two lines intersecting with the centerline of the ink supply opening 5).

As described above, sensors are provided along heating resistor elements arranged on the printing element substrate so that the diode sensors are arranged at a higher density a part having a higher temperature change of the printing element substrate in the operation for ejecting ink through the ejection openings. Neighboring sensors are divided to regions and the respective regions are subjected to heater control. This can consequently realize the printing element substrate that can subject the printing element substrate to an accurate temperature detection and that can suppress the printing element substrate from having a larger size.

(Third Embodiment)

The following section will describe the third embodiment of the present invention with reference to the drawings. This embodiment has the same basic configuration as that of the first embodiment and thus only a characteristic configuration will be described.

In this embodiment, the following section will describe the sensor arrangement and a temperature detection as well as a printing driving control method using the detected temperature when the printing element substrate 96 including 3 ink supply openings 5 is configured so that the same number of diode sensors are arranged within the respective columns in the direction along which the ejection openings are arranged.

Figure 9:
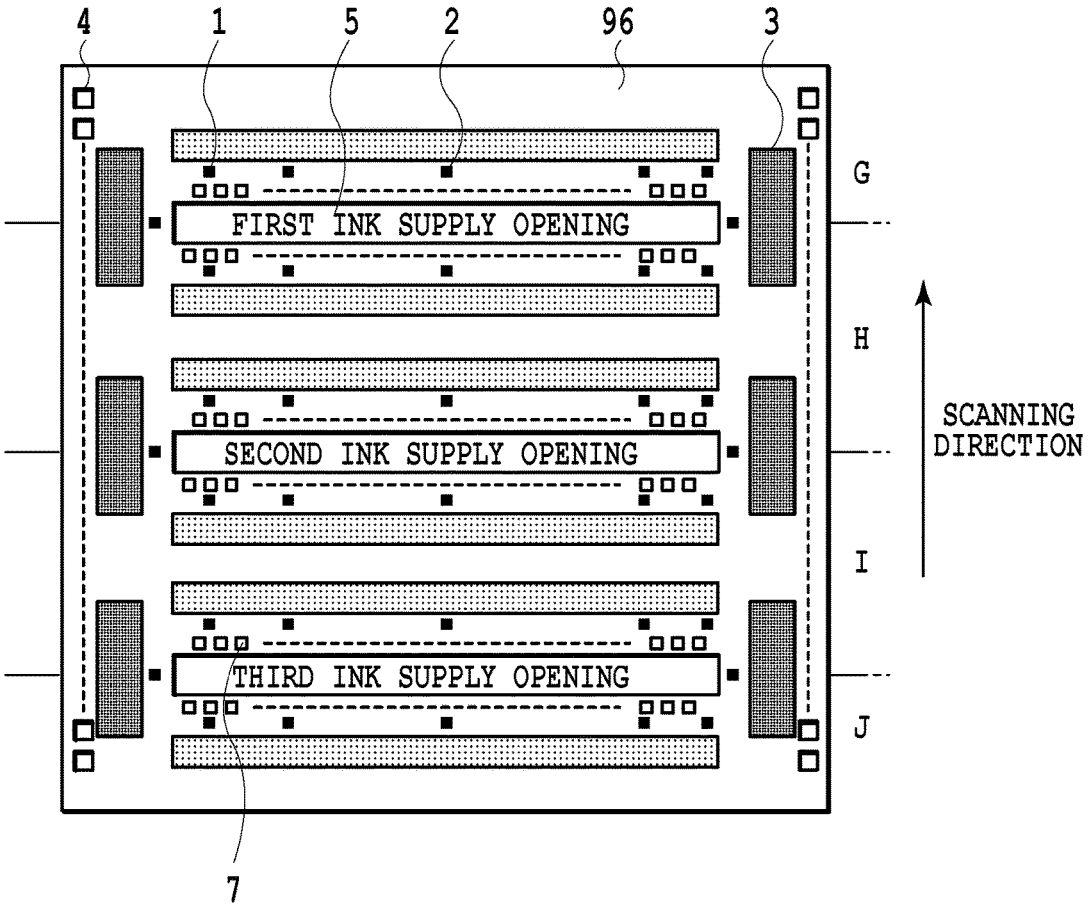
FIG. 9 illustrates the printing element substrate of the third embodiment.

FIG. 9 illustrates the printing element substrate of this embodiment. The printing element substrate 96 has a long side size of 1.07 inches and includes three first to third ink supply openings 5. Ejection openings for ejecting ink to correspond to the first ink supply opening 5 are arranged so that 640 ejection openings are arranged at the G side and the H side at both sides of the ink supply opening 5 to thereby form the total of 1280 ejection openings. The ejection openings are arranged at the G side and the H side in the vertical direction vertical to the scanning direction of the ink jet printing head during printing at a pitch of 600 dpi, respectively.

The ejection openings are arranged in a manner dislocated by a ½ pitch at the G side and the H side to thereby constitute the entirety having an ejection opening resolution of 1200 dpi. The same applies to the second and third ink supply openings. Since 3 ink supply openings 5 are provided, three difference inks can be used at a maximum. It is assumed that three colors of cyan, magenta, and yellow are supplied through the respective ink supply openings 5 for printing.

The diode sensors 1 for temperature detection are arranged as shown in FIG. 9 and the total of 36 diode sensors 1 are provided on the substrate. The diode sensors 1 at an end are provided on the G/H boundary line, the H/I boundary line, and the I/J boundary line passing through the center of the longitudinal direction of the ink supply opening 5 so as to be in the vicinity of the ejection openings.

The diode sensors 1 are arranged with a narrower interval from the center to the end (or with a higher density) and 5 diode sensors 1 are provided at both sides of the ink supply opening 5, respectively. By the above configuration, with regards to the ejection openings communicating with the respective ink supply openings 5, the temperature distributions of the four G, H, I, and J regions can be detected, thus providing a printing control with an improved image quality.

A temperature detection and the printing driving control method using the detected temperature are the same as those of the first embodiment. However, different inks may have different influences on an image due to a temperature change, it is not always required to control the respective 3 inks in the same manner. Specifically, even when diode sensors neighboring to each other at a certain timing have therebetween the same detected temperature difference, the number of control regions regarding the ejection openings therebetween may be different depending on to-be-used ink.

As described above, sensors are arranged along the heating resistor elements arranged in the printing element substrate so that more diode sensors are arranged at a higher density in a part having a higher temperature change of the printing element substrate during the liquid ejection operation from the ejection openings. Neighboring sensors are divided to regions so that the heaters are controlled for the respective regions. This can consequently realize the printing element substrate that can subject the printing element substrate to an accurate temperature detection and that can suppress the printing element substrate from having a larger size.

(Fourth Embodiment)

The following section will describe the fourth embodiment of the present invention with reference to the drawings. This embodiment has the same basic configuration as that of the first embodiment and thus only a characteristic configuration will be described.

Figure 10:
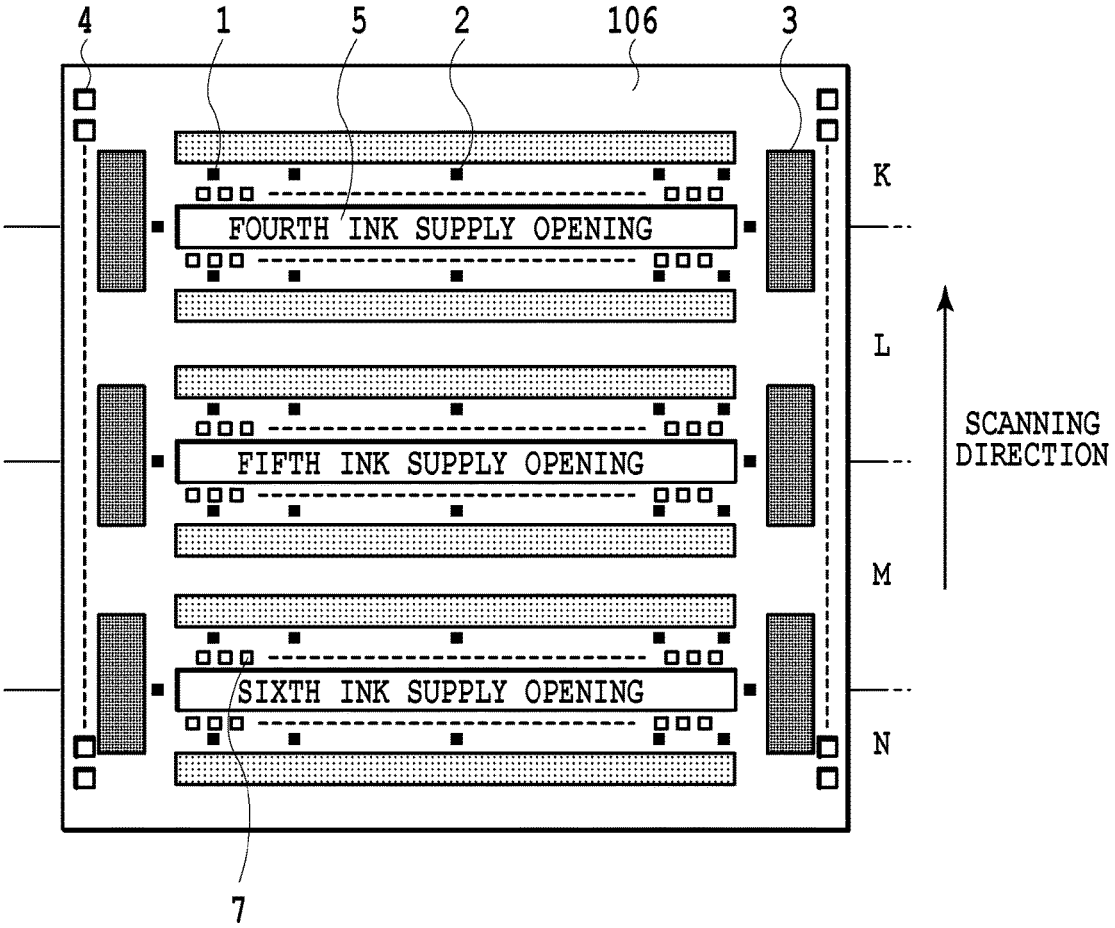
FIG. 10 illustrates the printing element substrate of the fourth embodiment.

FIG. 10 illustrates the printing element substrate of this embodiment. In this embodiment, the following section will describe the sensor arrangement and a temperature detection as well as a printing driving control method using the detected temperature when the printing element substrate 106 including 3 ink supply openings 5 is configured so that different numbers of diode sensors are arranged within the respective columns in the direction along which the ejection openings are arranged.

The following section will describe details of the printing element substrate 6 of FIG. 10. The substrate has a long side size of 1.07 inches and includes three fourth to sixth ink supply openings 5. Ejection openings for ejecting ink to correspond to the fourth ink supply opening are arranged so that 640 ejection openings are arranged at the K side and the L side at both sides of the fourth ink supply opening to thereby form the total of 1280 ejection openings.

The ejection openings are arranged at the K side and the L side in the vertical direction vertical to the scanning direction of the ink jet printing head during printing at a pitch of 600 dpi, respectively. The ejection openings are arranged in a manner dislocated by a ½ pitch at the K side and the L side to thereby constitute the entirety having an ejection opening resolution of 1200 dpi. The same applies to the fifth and the sixth ink supply openings. Since 3 ink supply openings 5 are provided, three difference inks can be used at a maximum. It is assumed that three colors of cyan, magenta, and yellow are supplied through the respective ink supply openings 5 for printing.

The diode sensors 1 for temperature detection are arranged as shown in FIG. 10 and the total of 32 diode sensors 1 are provided on the substrate. The diode sensors 1 at an end are provided on the K/Lboundary line, the L/M boundary line, and the M/N boundary line passing through the center of the ink supply opening 5 so as to be in the vicinity of the ejection openings. Furthermore, as shown in FIG. 10, 3 diode sensors 1 are provided at the K side and 5 diode sensors 1 are provided at the L side. Thus, when ink is simultaneously ejected through the ejection openings of the fourth ink supply opening and the ejection openings of the fifth ink supply opening, a heat amount two times higher than that of the K side is generated at the L side at a maximum.

The L side has a larger temperature difference than that of the K side. Thus, since the L side has a higher temperature than that of the K side, in order to perform a more-detailed temperature detection, the L side has diode sensors 1 increased by one than the number of those at the K side. The same applies to the M side and the N side by providing 5 diode sensors 1 at the M side and by providing 3 diode sensors 1 at the N side.

Figure 11:
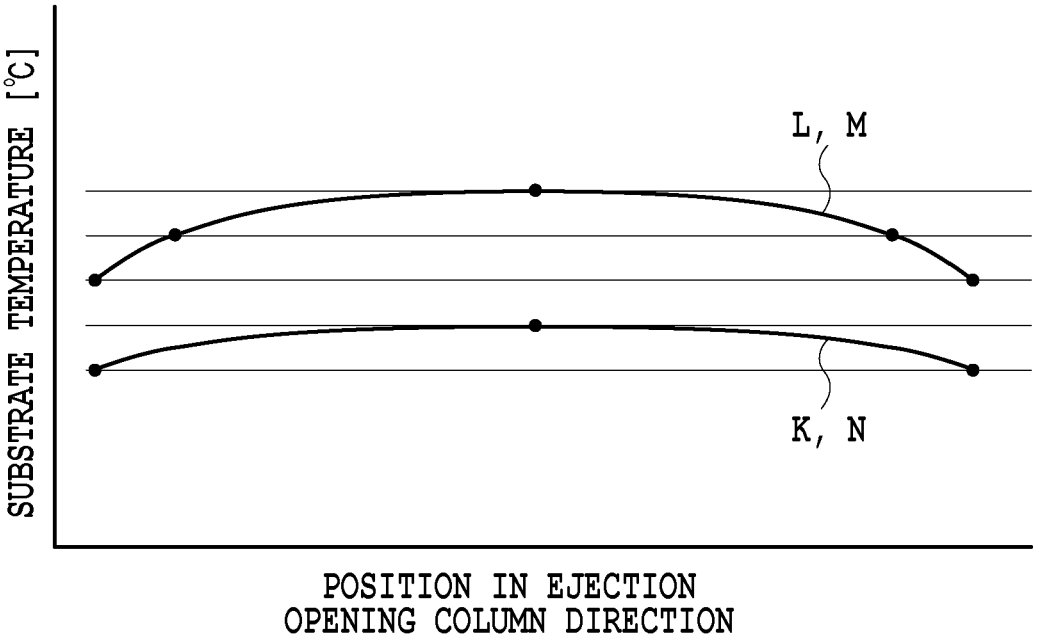
FIG. 11 illustrates the temperature distribution of a printing element substrate including three ink supply openings.

FIG. 11 is a graph illustrating the temperature distribution in the printing element substrate 106 including 3 ink supply openings. It can be seen that the L side and the M side have a higher temperature and a larger temperature difference when compared with the K side and the N side. When horizontal lines are drawn at a fixed temperature change in this graph, points as shown in the drawing can be plotted. Based on the plot positions, the diode sensors 1 are provided.

The L side has the diode sensors 1 provided in the vicinity of the ejection openings communicating with the fourth ink supply openings and in the vicinity of the ejection openings communicating with the fifth ink supply openings, thereby subjecting the respective ejection openings to a temperature detection. The arrangement of the diode sensors 1 as described above also can be applied to the M side.

As described above, the temperature distribution of the ejection openings communicating with the respective ink supply openings 5 can be detected by detecting the temperature distribution of the four regions K, L, M, and N, thus providing a printing control with an improved image quality.

A temperature detection and the printing driving control method using the detected temperature are the same as those of the first embodiment. However, different inks may have different influences on an image due to a temperature change, it is not always required to control the respective 3 inks in the same manner. Specifically, even when diode sensors neighboring to each other at a certain timing have therebetween the same detected temperature difference, the number of control regions regarding the ejection openings therebetween may be different depending on to-be-used ink.

As described above, sensors are arranged along the heating resistor elements arranged in the printing element substrate so that more diode sensors are arranged at a higher density in a part having a higher temperature change of the printing element substrate during the liquid ejection operation from the ejection openings. Neighboring sensors are divided to regions so that the heaters are controlled for the respective regions. This can consequently realize the printing element substrate that can subject the printing element substrate to an accurate temperature detection and that can suppress the printing element substrate from having a larger size.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-142444, filed Jul. 10, 2014, which is hereby incorporated by reference wherein in its entirety.

What is claimed is:

1. A printing element substrate comprising:

a plurality of ejection openings for ejecting liquid;

a plurality of temperature detection elements provided along the ejection openings;

heating resistor elements for generating energy for ejecting ink through the ejection openings and being provided to correspond to the ejection openings; and liquid supply openings for supplying liquid to the ejection openings, wherein the ejection openings and the heating resistor elements are provided along the liquid supply openings, wherein the temperature detection elements form a column, wherein the heating resistor elements are provided between the column of the temperature detection elements and the liquid supply openings, and wherein the temperature detection elements are arranged at a higher density during an operation for ejecting ink through the ejection openings in a part having a higher temperature change of the printing element substrate.

2. The printing element substrate according to claim 1, wherein the ejection openings form a column and are provided from a position in the vicinity of one end of the printing element substrate to a position in the vicinity of the other end, and the temperature detection elements are arranged at a higher density in a direction from the center to the end of the printing element substrate.

3. The printing element substrate according to claim 1, wherein the temperature detection elements are arranged to surround the liquid supply openings and at least one such temperature detection element is provided on the center line of the liquid supply openings along the column of the ejection openings and one such temperature detection element is provided on each of two lines intersecting with the center line, respectively.

4. The printing element substrate according to claim 3, wherein the printing element substrate further comprises:

a driver circuit for driving the heating resistor elements; and a logic circuit for controlling a signal to the driver circuit, wherein the temperature detection elements provided on the center line of the liquid supply openings are provided between the liquid supply opening and the driver circuit and the temperature detection elements provided on two lines intersecting with the center line are provided between the ejection openings and the logic circuit.

5. The printing element substrate according to claim 1, wherein the temperature detection element senses a temperature using a characteristic according to which an increase of a temperature of the printing element substrate causes an increase or a decrease of an output voltage during the application of constant current.

6. The printing element substrate according to claim 5, wherein the temperature detection element includes a diode sensor.

7. The printing element substrate according to claim 1, wherein the printing element substrate includes a plurality of the liquid supply openings.

8. A printing element substrate comprising:

an ejection opening column in which a plurality of ejection openings for ejecting liquid are arranged;

a heating resistor element column in which a plurality of heating resistor elements are arranged that generate energy for ejecting liquid through the ejection openings and that are provided to correspond to the ejection openings; and a temperature detection element column in which a plurality of temperature detection elements for detecting the heat of the printing element substrate are arranged, wherein the temperature detection element column is formed along the heating resistor element column, wherein, with regard to a direction along which the plurality of ejection openings are arranged, the heating resistor elements provided at the end side of the printing element substrate are arranged at a higher density than that at which the heating resistor elements provided at the center side of the printing element substrate are arranged, wherein the printing element substrate includes liquid supply openings for supplying liquid to the heating resistor elements, and wherein the heating resistor element column is provided between the temperature detection element column and the liquid supply openings.

9. A printing element substrate comprising:

an ejection opening column in which a plurality of ejection openings for ejecting liquid are arranged;

a heating resistor element column in which a plurality of heating resistor elements are arranged that generate energy for ejecting liquid through the ejection openings and that are provided to correspond to the ejection openings; and a temperature detection element column in which a plurality of temperature detection elements for detecting the heat of the printing element substrate are arranged, wherein the temperature detection element column is formed along the heating resistor element column, wherein, with regard to a direction along which the plurality of ejection openings are arranged, the heating resistor elements provided at the end side of the printing element substrate are arranged at a higher density than that at which the heating resistor elements provided at the center side of the printing element substrate are arranged, wherein the printing element substrate includes liquid supply openings for supplying liquid to the heating resistor elements, and wherein the heating resistor element column is provided between the temperature detection element column and the liquid supply openings, and wherein the temperature detection elements are provided to surround the liquid supply openings.

10. The printing element substrate according to claim 9, wherein the temperature detection elements are arranged, with regard to the direction, on an extension line at one end side of the supply opening and an extension line at the other end side.

11. A liquid ejection head comprising a printing element substrate having:

a plurality of ejection openings for ejecting liquid;

a plurality of temperature detection elements provided along the ejection openings;

heating resistor elements for generating energy for ejecting ink through the ejection openings and being provided to correspond to the ejection openings; and liquid supply openings for supplying liquid to the ejection openings, wherein the ejection openings and the heating resistor elements are provided along the liquid supply openings, wherein the temperature detection elements form a column, wherein the heating resistor elements are provided between the column of the temperature detection elements and the liquid supply openings, and wherein the temperature detection elements are arranged at a higher density during an operation for ejecting ink through the ejection openings in a part having a higher temperature change of the printing element substrate.

12. A liquid ejection apparatus that can include therein a liquid ejection head having a printing element substrate having:

a plurality of ejection openings for ejecting liquid;

a plurality of temperature detection elements provided along the ejection openings;

heating resistor elements for generating energy for ejecting ink through the ejection openings and being provided to correspond to the ejection openings; and liquid supply openings for supplying liquid to the ejection openings, wherein the ejection openings and the heating resistor elements are provided along the liquid supply openings, wherein the temperature detection elements form a column, wherein the heating resistor elements are provided between the column of the temperature detection elements and the liquid supply openings, and wherein the temperature detection elements are arranged at a higher density during an operation for ejecting ink through the ejection openings in a part having a higher temperature change of the printing element substrate.

13. The liquid ejection apparatus according to claim 12, wherein the printing element substrate includes a heating resistor element for generating energy for ejecting liquid through the ejection opening, and wherein the temperature detection elements have therebetween at least one or more regions, and based on the temperature detected by the temperature detection elements, the respective heating resistor elements corresponding to the regions are controlled.

14. A liquid ejection head comprising a printing element substrate comprising:

an ejection opening column in which a plurality of ejection openings for ejecting liquid are arranged;

a heating resistor element column in which a plurality of heating resistor elements are arranged that generate energy for ejecting liquid through the ejection openings and that are provided to correspond to the ejection openings; and a temperature detection element column in which a plurality of temperature detection elements for detecting the heat of the printing element substrate are arranged, wherein the temperature detection element column is formed along the heating resistor element column, wherein, with regard to a direction along which the plurality of ejection openings are arranged, the heating resistor elements provided at the end side of the printing element substrate are arranged at a higher density than that at which the heating resistor elements provided at the center side of the printing element substrate are arranged, and wherein the temperature detection elements are provided to surround the liquid supply openings.

* * * * *